United States Patent [19]

Haymer

[11] Patent Number: 4,610,037

[45] Date of Patent: Sep. 9, 1986

[54] TIE CONSTRUCTION

[76] Inventor: Xavier Haymer, 2113 W. Broadway, Forrest City, Ark. 72335

[21] Appl. No.: 704,905

[22] Filed: Feb. 22, 1985

Related U.S. Application Data

[63] Continuation of Ser. No. 517,701, Jul. 27, 1983.

[51] Int. Cl.[4] ..... A41D 25/02

[52] U.S. Cl. ..... 2/145; 2/150; 2/157

[58] Field of Search ..... 2/144, 145, 150, 155, 2/157, 149

[56] References Cited

U.S. PATENT DOCUMENTS

| | | | |
|---|---|---|---|
| 346,041 | 7/1886 | Heath | 2/144 |
| 401,690 | 4/1889 | Cole | 2/150 |
| 517,769 | 4/1894 | Selowsky | 2/144 |
| 1,170,437 | 2/1916 | Essex | 2/149 |
| 1,375,190 | 4/1921 | Waller | 2/145 |
| 1,798,432 | 3/1931 | Ratajack | 2/145 |
| 2,100,870 | 11/1937 | Petrie et al. | 2/145 |
| 2,388,993 | 11/1945 | Pfau | 2/150 |
| 2,746,055 | 5/1956 | Gleason | 2/145 |
| 2,860,346 | 11/1958 | Siebler et al. | 2/157 |
| 2,886,823 | 5/1959 | Kuhlman | 2/145 |
| 2,946,106 | 7/1960 | Moran | 2/145 X |
| 3,639,916 | 2/1972 | Vaughn | 2/145 X |
| 3,735,420 | 5/1973 | New | 2/150 |

*Primary Examiner*—Louis K. Rimrodt

*Attorney, Agent, or Firm*—Philip Furgang

[57] ABSTRACT

A tie panel extends down from a tie knot to which is attached a neckband for disposition around the neck of a wearer so that the tie panel extends downwardly from the tie knot when the tie is worn. A number of buttonholes extend through the tie panel and receive the buttons from the wearer's shirt to thereby position the tie up against the wearer's shirt. Additionally, the tie panel is formed with stitching along its edging simulating the stitching on the wearer's shirt front. The lower end of the tie panel is tapered inwardly and formed to be folded under and against the rear face of the tie panel; and to be adjustably secured in position by means of a pair of spaced straps, a number of buttonholes and an attaching button all secured to the rear face of the tie panel. When so selectively secured the tie length can be adjusted according to the wearer's height, body proportions and personal desires. The tie knot and tie panel are preferably formed from different materials; with the tie knot being able to take the form of a flower.

5 Claims, 5 Drawing Figures

TIE CONSTRUCTION

This is a continuation of co-pending application Ser. No. 517,701 filed on July 27, 1983.

BACKGROUND OF THE INVENTION-FIELD OF APPLICATION

This invention relates to ties; and more particularly to the particular construction of a tie which is pre-made and includes a neckband.

BACKGROUND OF THE INVENTION-DESCRIPTION OF THE PRIOR ART

Many men, and some women, wear ties as part of their attire. Ties are worn to work, and/or for dress after work, and for many other occasions. But conventional tie constructions require the wearer to not only wrap a portion of the tie neatly around their neck, but to also tie a knot and somehow align the front and back portions of the tie all into a neat and smooth looking arrangement. Thereafter many tie wearers prefer to utilize a tie tack, tie clip or other holder to keep the front and back portions of the tie together; to thereby hide the back portion of the tie, behind the front portion, and to otherwise keep the tie in place against their shirt and hopefully out of the soup. But this requires the user to keep tie tacks, clips and holders on hand and to match the tie tacks, clips and holders to the tie, shirt and other clothes. Many such tie tacks, clips and holders are relatively expensive and since they are usually small easy to lose.

In an effort to avoid the aforementioned undesirable features of conventional ties some ties are fabricated with a simulated tie construction. That is, one in which the tie is pre-made and includes a tie panel with a permancent knot formed at the top and a neckband or other construction to facilitate securing the tie in place around the wearer's neck. However, simulated, or pre-made, tie constructions of the type shown in U.S. Pat. No. 3,097,362 granted to Dinn include special fasteners provided on the tie which are to be secured to the fasteners provided on the shirt. If the special fasteners of Dinn's tie construction become damaged or lost then the entire tie is no longer usable. In addition, Dinn's special fasteners add bulk to the tie construction and may affect the appearance of the tie when worn.

Other available simulated, or pre-made, tie constructions, such as shown in U.S. Pat. No. 3,639,916 granted to Vaughn replace Dinn's special fasteners by utilizing cuff links to hold the pre-made tie in place. However, it should be obvious that the inserted end of a cuff link, as used by Vaughn may become bothersome to the neck of the wearer of the tie. To attempt to minimize this problem by utilizing a protective pad as shown by Vaughn, merely increases the bulk of the overall construction in the area of the user's neck and the probable discomfort to the wearer. Furthermore, Vaughn's tie Some conventional tie constructions, such as the one shown in U.S. Pat. No. 2,813,273 granted to Schreter, attempt to avoid the need for a tie tack, tie clip or other tie holder by including button hole like openings in the narrow end of the tie which cooperate with the shirt buttons on the shirt of the wearer. However, this still leaves a tie construction which must be tied around the neck of the user for each wearing, and which, more importantly, has both a front and a back tie panel when worn. While the back panel is held in place by the Schreter tie construction, the front panel is not, since it is the concept of this type of tie construction to hide the shirt front and shirt buttons from view, and not include the shirt buttons as part of the wearer's appearance.

It is furthermore quite bothersome to make a tie each time one has to wear the tie, and then to unmake the tie prior to taking it off and putting it away. Many people are most meticulous in their appearance and want the tie to look the same, and be the same length each time it is made. This can become an ordeal; especially in the morning when one is in a hurry to go to work, or at night when one does not want to be late for a date. Also, ties quite often wrinkle in the area where the knot is formed and if not made the next time exactly as the previous time the wrinkles may show and may spoil the otherwise clean and smooth looking appearance of the tie. construction requires the availability and cost of cuff links; and concern for how and if the cuff links match the shirt, tie, and other clothing of the wearer.

Furthermore available tie constructions, even the pre-made ones, still provide a tie which looks like a conventional tie when worn in that the knot portion of the tie usually looks like the rest of the tie and the tie panel usually provides an appearance quite different from the front of the wearer's shirt. Additionally, even the pre-made available ties sometimes fail to recognize that people come in many different heights and with many different tastes as to how long they want their ties to be.

SUMMARY OF THE INVENTION

It is therefore an object of this invention to provide a new and improved tie construction.

It is another object of this invention to provide a new and improved pre-made tie construction.

It is yet another object of this invention to provide a new and improved combination of tie and tie knot for a pre-made tie construction.

It is yet still another object of this invention to provide a new and improved pre-made tie construction which utilizes the buttons of the wearer's shirt to hold the front and only tie panel in place.

It is yet still a further object of this invention to provide a new and improved pre-made tie construction which incorporates the buttons of the wearer's shirt into the tie appearance.

It is yet still a further object of this invention to provide a new and improved pre-made tie construction which simulates the stitched construction of the wearer's shirt front.

It is yet still a further object of this invention to provide a new and improved pre-made tie construction which permits easy and hidden adjustment of the length of the tie panel.

This invention involves a tie construction, and contemplates: providing tie panel means; tie knot means connected proximate a predetermined end of said tie panel means; neckband means connected to said tie knot means and formed to fasten said tie knot means about the neck of a wearer so that said tie panel means extends down from said tie knot means in front of a shirt when worn by a wearer; said tie panel means including a plurality of buttonholes extending therethrough and spaced from each other and sized to receive through said buttonholes buttons from the shirt of the wearer so that when so disposed the buttons appear in front of said tie panel.

Other objects, features, and advantages of the invention in its details of construction and arrangement of parts will be seen from the above, from the following description of the preferred embodiment when considered with the drawing and from the appended claims.

DESCRIPTION OF THE PREFERRED EMBODIMENTS

Figure 1:
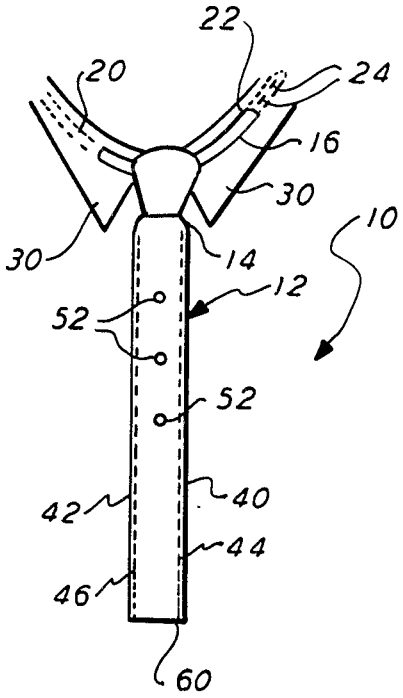
FIG. 1 is a front view of tie incorporating the instant invention and showing same in place around a wearer's neck and as held to the wearer's shirt front.
Figure 2:
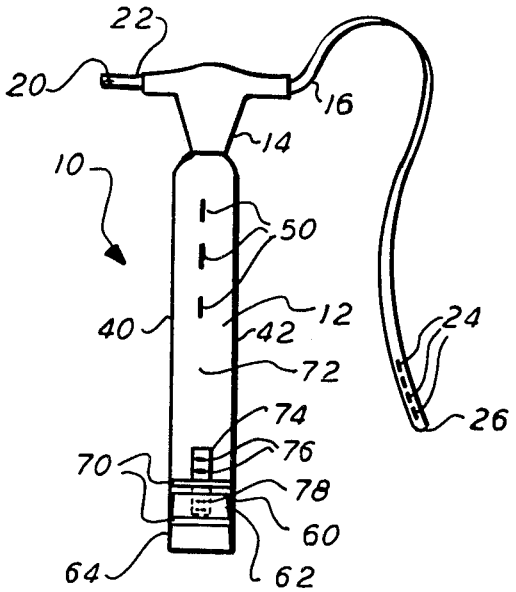
FIG. 2 is a back view of the tie of FIG. 1 removed from its position on the wearer.

With reference to FIGS. 1 and 2 there is generally shown at 10 a tie of pre-made construction incorporating a tie panel 12, tie knot 14 and neckband 16.

The knot 14 shown provides a particular configuration but other familiar configurations may just as well be utilized. The material for tie knot 14 is different from that of the material of tie panel 12 and as such provides a functional and yet pleasing appearance for the wearer. Since many different materials may be selected for tie knot 14 and tie panel 12 the number of possible combinations of tie knots 14 with tie panels 12 is substantially infinite.

Neckband 16 is formed from elastic type material but a non-elastic material may be used just as well. A button 20, or other suitable fastener is secured at an end 22 of neckband 16 for cooperation with any one of a number of buttonholes 24 formed proximate end 26 of neckband 16. If other than a button is provided as the fastening means (such as a hook) for neckband 16, then holes 24 are suitably formed to cooperate with the other fastening means. Neckband 16 is disposed around the neck of the wearer, under their shirt collar 30 (FIG. 1) and is secured in place by inserting button 20 through one of the buttonholes 24.

Tie panel 12 is formed from suitable material with relatively straight sides 40, 42 and with lines of stitching 44, 46 spaced and otherwise formed to simulate the stitching on the front of a conventional shirt. A number of buttonholes 50 (FIG. 2) are formed through tie panel 12 in the same manner that buttonholes are formed on shirts. Buttonholes 50 are sized, spaced and otherwise formed to receive shirt buttons 52 (FIG. 1) so that when tie 10 is positioned on a wearer the buttons 52 of the wearer's shirt extend through buttonholes 50 to hold tie panel 12 in place with its stitching 42, 44 positioned in alignment and in front of the stitching on the front of the wearer's shirt.

A lower portion 60 of tie panel 12 is formed with its sides 62, 64 (FIG. 2) tapered inwardly to facilitate disposition of lower end 60 under one or both of a pair of bands 70 secured to the rear face 72 of tie panel 12 proximate lower end 60 thereof. A relatively small patch of material 74 is formed with a number of spaced buttonholes 76 and is secured in place to rear face 72 of tie panel 12 so as to be able to receive a button 78 attached to rear face 72 of tie panel 12 proximate the very end thereof. As such adjustment of the length of tie panel 12 to accommodate the height, body proportions and desires of the wearer is easy to accomplish. The wearer need only fold lower end 60 of tie panel under and slide it under one or both bands 70. Button 78 is then inserted through the nearest buttonhole 76 in patch 74 and the length of tie panel 12 is established.

When wearing tie 10 the wearer may either adjust the length of tie panel 12, as described above, before or after putting tie 10 on. Neckband 16 is wrapped around the wearer's neck and disposed under their shirt collar 30. Button 20 is thereafter inserted through one of the holes 24 to suit the fit and comfort of the wearer. Buttons 52 of the wearer's shirt are thereafter inserted through buttonholes 50 of tie panel 12 and tie 10 is in place with its stitching lines 42, 44 simulating those of the wearer's shirt. To remove tie 10 the wearer need only unbutton buttons 52 from holes 50, unbutton 20 from its hole 24 and remove neckband 16 from under their shirt collar 30.

Figure 3:
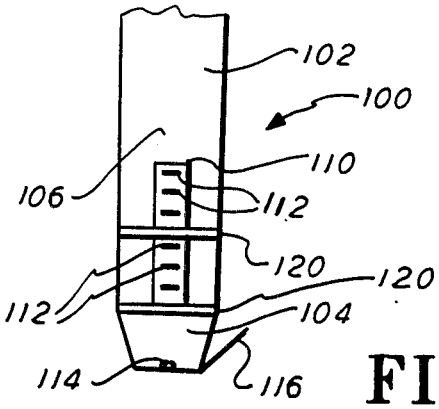
FIG. 3 is a back view of a modified lower end for the tie panel of FIGS. 1 and 2.
Figure 4:
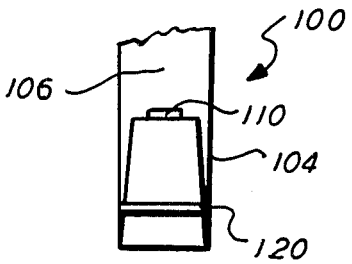
FIG. 4 is another view of the tie panel lower end of FIG. 3, showing same in an adjusted position.

In the embodiment of FIGS. 3 and 4 there is shown a tie 100 with a tie panel 102 having a lower end 104. A rear face 106 of lower end 104 of tie panel 102 has affixed thereto a patch of material 110 with six buttonholes 112 formed therein for cooperation with a button 114 secured proximate the tip 116 of lower end 104 of tie panel 102. A pair of bands 120 of material are appropriately secured in spaced relationship to each other on rear face 106 of tie panel 102 to facilitate adjustment of the length of tie panel 102 to suit the height, body proportions and desires of the wearer. To adjust the length of tie panel 102 the wearer need only fold under lower end of 104 of tie panel 102 and slip it through one or the other (or both) bands 120. Button 114 is then inserted through an appropriate buttonhole 112 and tie 10 is adjusted in length.

Figure 5:
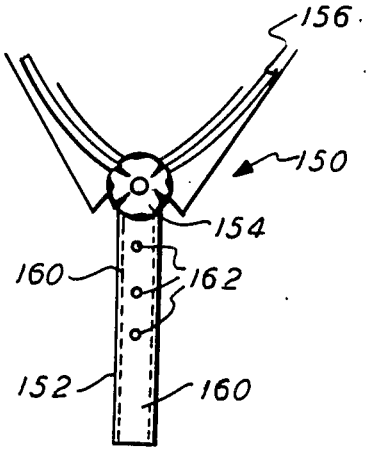
FIG. 5 is a front view of a tie similar to that of FIG. 1 but showing a modified tie knot construction.

In the embodiment of FIG. 5 a tie 150 is shown to include a tie panel 152, tie knot 154 and neckband 156. Tie panel 152 is formed with stitching 160, buttonholes 162, and otherwise as described for tie 10 of FIGS. 1 and 2. Neckband 156 is also formed with a fastener and holes as described for neckband 16 of tie 10 of FIGS. 1 and 2. However, tie knot 156 of tie 150 is formed of a material and configuration to simulate any one of a desired flower configuration as shown. Tie 150 is worn and removed in the same manner as the tie of FIGS. 1 and 2.

From the above description it will thus be seen that there has been provided a pre-made tie construction which is simple and efficient in construction and to wear, and which incorporates different materials in its construction and otherwise incorporates securing, simulation and adjustment features that provide a pleasing and desired effect when worn.

It is my understanding that although I have shown the preferred form of my invention that various modifications may be made in the details thereof without departing from the spirit as comprehended by the following claims.

I claim:

1. A tie of the type intended to be worn by wearer with a shirt having buttons and buttonholes arranged at intervals along with front of the shirt, the tie comprising:

(a) a single tie panel formed with relatively straight sides and stitching extending proximate and along each side and providing the appearance of shirt front stitching; said tie panel includes a lower end which is tapered inwardly for a predetermined length thereof and securing means are provided to secure said lower end of said tie panel in a bent under manner behind said tie panel; said securing means includes at least one securing strap formed of a predetermined material and securing button attached to the rear face of said tie panel and includes a patch of material attached to said rear face of said tie panel and a plurality of buttonholes formed in said patch of material or cooperation with said securing button;

(b) tie knot means connected proximate a predetermined end of said tie panel;

(c) a neckband connected to said tie knot means and formed to fasten said tie knot means about the neck of the wearer so that said tie panel extends down from said tie knot means in front of the shirt when worn by the wearer;

(d) said tie panel includes a plurality of buttonholes extending therethrough and spaced from each other end sized to receive through the buttons of the shirt of the wearer so that when so disposed the buttons of the shirt are, when passed through said tie panel buttonholes, in front of said tie panel and secured said tie panel to the shirt.

2. The tie of claim 1, wherein said tie knot is formed of a first material and said tie panel is formed of a second material different from said first material.

3. The tie of claim 2, wherein said tie knot is in the configuration to provide the simulated appearance of a flower.

4. The tie of claim 1, wherein said neckband means is formed from stretchable means disposed proximate at first one of its ends and a plurality of fastener catch means disposed proximate a second one of its ends.

5. The tie of claim 4, wherein said fastener means is a button and said fastener catch means are buttonholes.

* * * * *